US007539450B2

(12) United States Patent
Aze et al.

(10) Patent No.: US 7,539,450 B2
(45) Date of Patent: May 26, 2009

(54) IMAGE FIXING APPARATUS AND IMAGE FORMING APPARATUS THAT MAINTAINS HIGH EFFICIENCY IN HEAT GENERATION AND REDUCES LOSS IN POWER CONSUMPTION

(75) Inventors: Norihiko Aze, Zama (JP); Machida Hidenori, Ebina (JP); Tsuneaki Kondoh, Ayase (JP); Satoshi Tohkai, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/613,039

(22) Filed: Dec. 19, 2006

(65) Prior Publication Data

US 2007/0140758 A1 Jun. 21, 2007

(30) Foreign Application Priority Data

Dec. 19, 2005 (JP) ..... 2005-365578

(51) Int. Cl.
*G03G 15/20* (2006.01)

(52) U.S. Cl. ..... 399/329; 399/328; 399/320; 219/216

(58) Field of Classification Search ..... 399/330, 399/335, 336, 328, 67; 219/216
See application file for complete search history.

(56) References Cited

U.S. PATENT DOCUMENTS 6,229,126 B1 * 5/2001 Ulrich et al. ..... 219/635
6,661,991 B2 * 12/2003 Naito et al. ..... 399/328
6,861,124 B2 3/2005 Kamiya et al.
6,911,240 B2 6/2005 Kondoh
7,024,923 B2 4/2006 Aze et al.
7,106,999 B2 * 9/2006 Takahashi ..... 399/328
7,146,126 B2 12/2006 Yoshii et al.
7,359,667 B2 * 4/2008 Kwak et al. ..... 399/330
2002/0150412 A1 * 10/2002 Nakayama ..... 399/330
2003/0228179 A1 * 12/2003 Yaomin et al. ..... 399/329
2003/0235417 A1 12/2003 Aze et al.
2004/0099650 A1 * 5/2004 Imai et al. ..... 219/221
2004/0224165 A1 11/2004 Kondoh et al.
2005/0095381 A1 5/2005 Kondoh
2005/0123673 A1 6/2005 Kamiya et al.
2005/0286938 A1 * 12/2005 Aze et al. ..... 399/328
2006/0056890 A1 3/2006 Aze et al.
2006/0120778 A1 6/2006 Aze et al.
2006/0198666 A1 9/2006 Kondoh et al.

FOREIGN PATENT DOCUMENTS

JP 2000-268952 9/2000

(Continued)

OTHER PUBLICATIONS

Fairvie Coil Fabrication. 80 Fariview Rd, Scottsville, NY 14546 See website http://www.coilfab.com/coils.html.*

*Primary Examiner*—David M Gray
*Assistant Examiner*—G. M. Hyder
(74) *Attorney, Agent, or Firm*—Oblon, Spivak, McClelland, Maier & Neustadt, P.C.

(57) ABSTRACT

An image fixing apparatus stably maintains high efficiency in heat generation and reduces loss of electric power consumption for fixing an image, which includes a coil member to generate a magnetic flux, a heat member to generate heat with the magnetic flux, and a support member to support the coil member so that the coil member faces a front and a back side of the heat member, wherein the support member includes a heat dissipation part that releases heat generated in the coil member.

21 Claims, 13 Drawing Sheets

FOREIGN PATENT DOCUMENTS

| | | |
|---|---|---|
| JP | 2001-013805 | 1/2001 |
| JP | 2002-043047 | 2/2002 |
| JP | 2002-082549 | 3/2002 |
| JP | 2002-174971 | 6/2002 |
| JP | 2003-076173 | 3/2003 |
| JP | 2003-215956 | 7/2003 |
| JP | 2005-070376 | 3/2005 |
| JP | 2005-221538 | 8/2005 |

* cited by examiner

IMAGE FIXING APPARATUS AND IMAGE FORMING APPARATUS THAT MAINTAINS HIGH EFFICIENCY IN HEAT GENERATION AND REDUCES LOSS IN POWER CONSUMPTION

CROSS-REFERENCE TO RELATED APPLICATIONS

This patent specification is based on Japanese patent application, No. JP 2005-365578 filed on Dec. 19, 2005 in the Japan Patent Office, the entire contents of which are incorporated by reference herein.

BACKGROUND

1. Field of Invention

Exemplary aspects of the present invention generally relate to an image fixing apparatus and an image forming apparatus, and more particularly to an image fixing apparatus using an electromagnetic induction heating system which is included in an image forming apparatus such as a printer, a copying machine, a facsimile, etc.

2. Background

A related art image fixing apparatus using an electromagnetic induction heating system reduces a temperature increase time of an image forming apparatus for a purpose of saving energy.

For example, a related art image fixing apparatus using an electromagnetic induction heating system includes a support roller (a heat roller), an auxiliary fixing roller (a fixing roller), a fixing belt which is tensed between the support roller and the auxiliary fixing roller, an induction-heating device that counters the support roller through the fixing belt and a pressing roller which is in contact with the fixing belt on the auxiliary fixing roller. The induction-heating device includes a coil member (an excitation coil) that extends in a width direction (a main scanning direction) and a core member.

The fixing belt is heated at a position where the fixing belt faces the induction-heating device. A toner image on a recording medium is conveyed to a position between the auxiliary fixing roller and the pressing roller, and heated by the fixing belt, and fixed on the recording medium. In more detail, applying the coil member with a high frequency alternate current causes a magnetic field around the coil member. An eddy current is generated near the support roller surface. The eddy current causes a heat increase using a resistance of the support roller itself. The fixing belt is heated with the increased heat, and is tensed by the support roller. In a related art image fixing apparatus using an electromagnetic induction heating system the image fixing apparatus may increase a surface temperature (a fixing temperature) of the fixing belt to a predetermined temperature with a small amount of energy and a short temperature increase time.

In another example, a related art image fixing apparatus using an electromagnetic induction heating system includes a fixing roller (a heat roller) which is made of a ferromagnetic material and an excitation coil formed around the inside and outside of the fixing roller. This related art image fixing apparatus increases a heat generating efficiency in the fixing roller.

When fixing on a small size recording medium is continuously performed using the above-mentioned related art image fixing apparatus or a driving of the image fixing apparatus is irregularly stopped by a paper jam and so on, temperature of a part or all of a fixing member, such as a fixing belt, may excessively increase.

In more detail, a general image forming apparatus is constituted so that image formation may be performed on various types of recording media with which the sizes of a width direction of the recording media differ. The recording media have different sizes in a width direction, such as an A sequence and B sequence in Japanese Industrial Standards (JIS) regulation, and irregular sizes. Even if the same A4 size sheets are used, the width lengths differ depending on feeding direction of the sheets.

When fixing on such recording media is performed using a related art fixing apparatus, heat distribution of the fixing belt in a width direction is varied and unevenness of heat may occur. For example, when a narrow width recording medium is fed, a part of the fixing belt which is in contact with the narrow recording medium decreases in temperature due to heat consumption into the recoding medium as compared with the other part of the fixing belt. This phenomenon is especially remarkable when a narrow recording medium is continuously fed.

When a temperature of a central part of the fixing belt is used as a reference temperature, although the temperature of the central part of the fixing belt is controllable to a required temperature, the other parts of the fixing belt, such as an end position, may excessively increase in temperature. Thus, when a wide recording medium is fixed, a hot offset may occur at the high temperature position. Further, when a fixing temperature at both ends of the fixing belt is higher than a heat-resistant limit, a thermal breakage may occur in the fixing belt.

To control the temperature of the whole region of the fixing belt with a temperature of an end part of the fixing belt as a reference temperature, although the temperature of the end part of the fixing belt is controllable to a required temperature, the central part of the fixing belt may excessively decrease in temperature. Thus, when a recording medium is fixed, a cold offset may occur at low temperature position.

When a paper jam occurs, an applied drive to the fixing apparatus may be stopped suddenly. In this case, a portion of the fixing belt which counters an induction-heating device may excessively increase in temperature at a cutting off time of electricity into the induction-heating device. This may cause a thermal breakage in components such as the fixing belt and the coil member of the induction-heating device.

A position of the coil part to a heat device tends to vary in the related art image fixing apparatus, and a heat efficiency of the heat device may not be stable. That is, the heat efficiency of the heat device may be changed with the position of the heat device in a magnetic field generated by the coil member. Thus, when the heat efficiency of the heat device varies, a temperature increase time may differ according to an image forming apparatus. Such a problem may notably occur when the coil member is arranged so that it faces the front or back side of the heat device.

In the above-mentioned related art image fixing apparatus, heat generation of a coil member itself increases a resistance of the coil member. This increases a heat loss of the coil member and a power consumption. Further, a covering layer of the coil member may be damaged. When the coil member is arranged near the heat device in order to improve heat efficiency, temperature of the coil member may increase higher because the coil member easily receives a radiant heat from the heat device. These problems may notably occur when the coil member is arranged so that it faces the front or back side of the heat device of a support roller. The coil member facing an outside surface of the support roller has a wide open area around it, so that it is easy to release heat. But, the coil member facing an inside surface of the support roller has a narrow open area around it, so that it is hard to release heat. This may cause those problems.

In one of the above examples, the related art image fixing apparatus of electromagnetic induction heating system includes a fixing roller (a heat roller) which is made of a ferromagnetic material, an excitation coil formed around the inside and outside of the fixing roller. This related art image fixing apparatus increases a heat generating efficiency in the fixing roller. But this related art image fixing apparatus may not control the above-mentioned excessive temperature of the heat device. A position of the excitation coil member to the heat device may vary in the background image fixing apparatus, and a heat efficiency of the heat device may not be stable. Further, high temperature of the excitation coil member may increase a power consumption.

SUMMARY

An image fixing apparatus or an image forming apparatus stably maintains high efficiency in heat generation and reduces loss of electric power consumption for fixing an image, and includes a coil member to generate a magnetic flux, a heat member to generate heat with the magnetic flux, and a support member to support the coil member so that the coil member faces a front and a back side of the heat member. The support member includes a heat dissipation part that releases heat generated in the coil member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
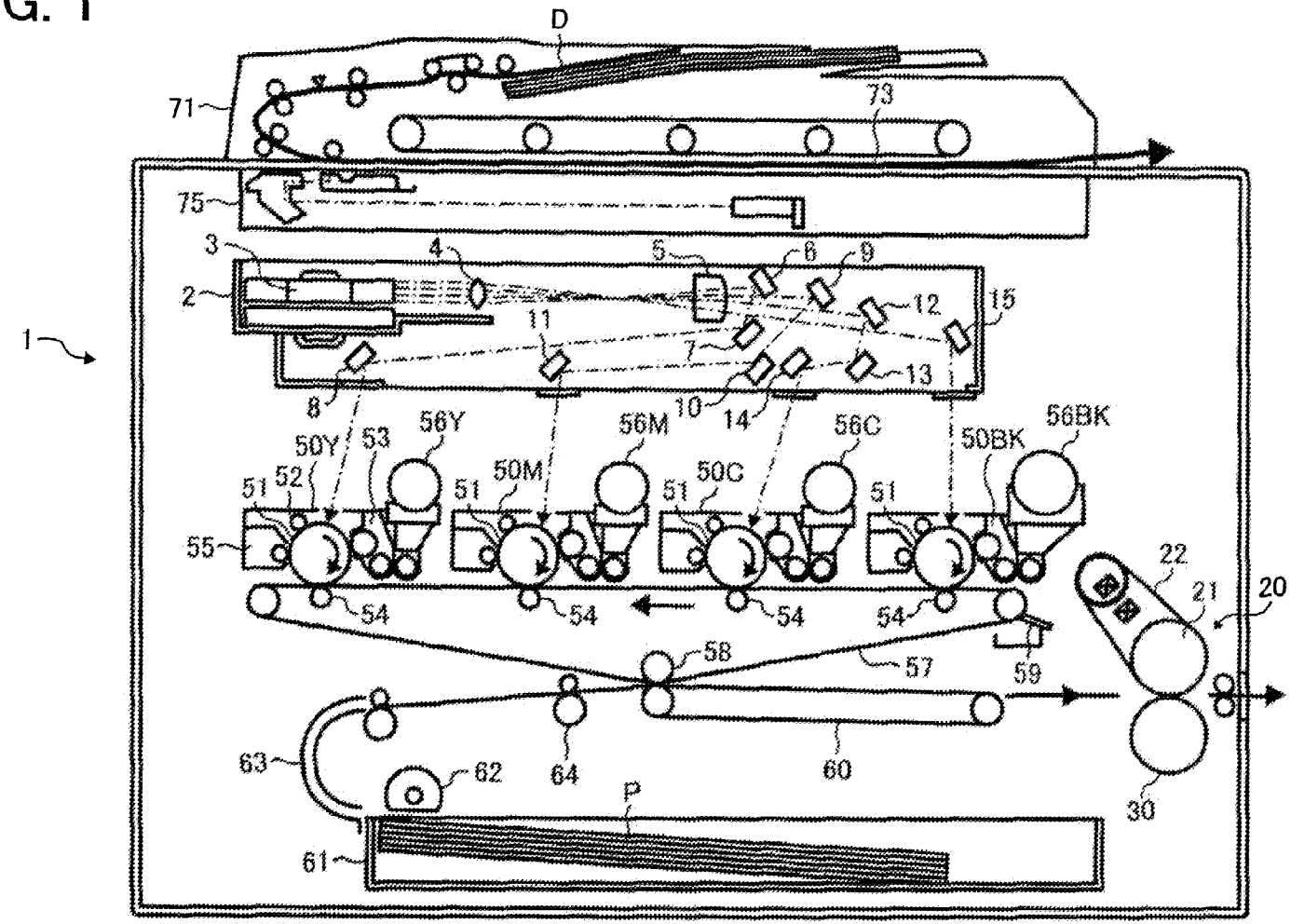
FIG. 1 is a cross-sectional diagram illustrating an exemplary configuration of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an exemplary configuration of an image forming apparatus according to an exemplary embodiment of the present invention is explained.

Figure 2:
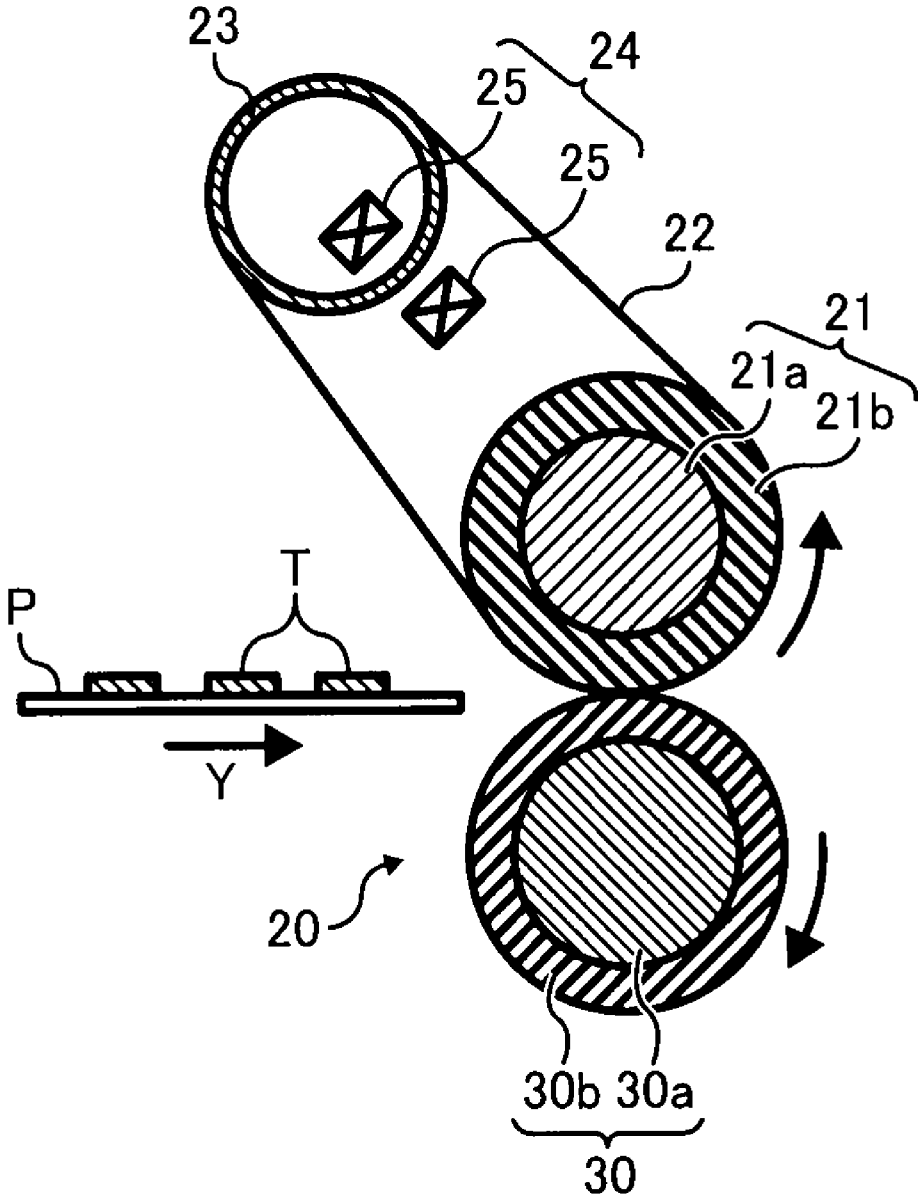
FIG. 2 is a cross-sectional diagram illustrating an exemplary configuration of an image fixing apparatus in the image forming apparatus of FIG. 1.
Figure 3:
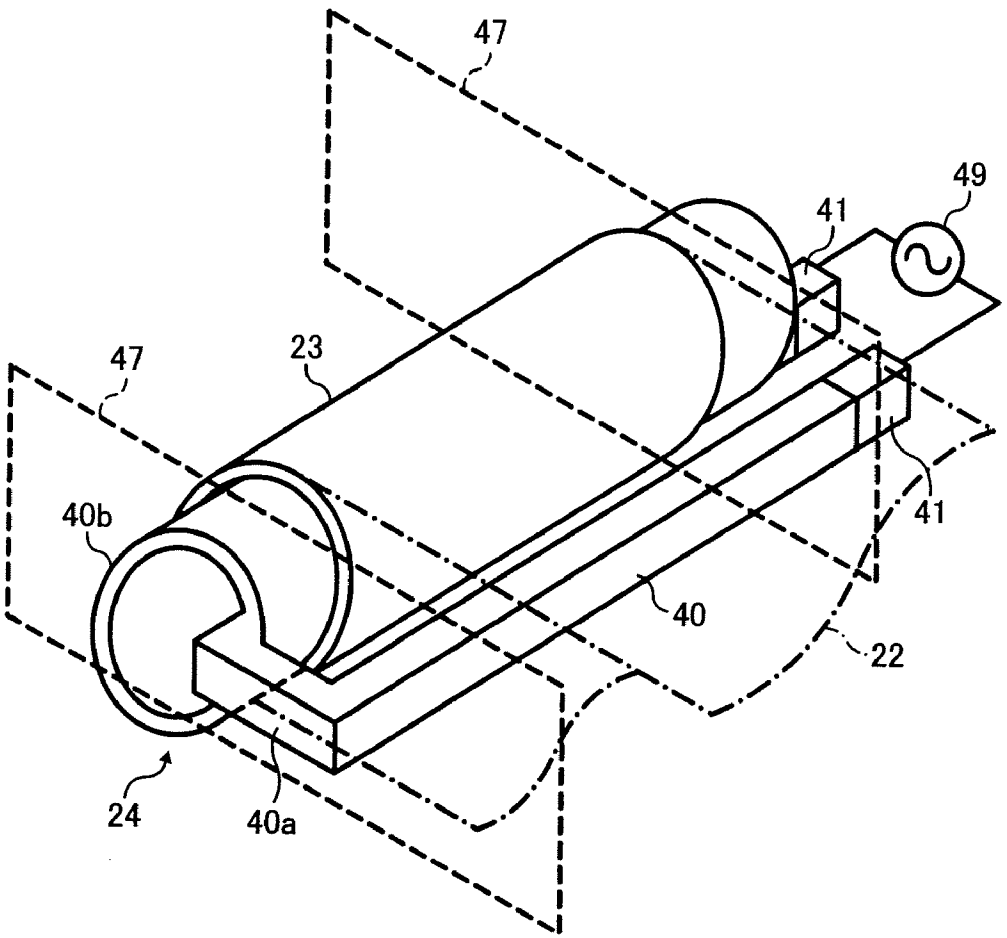
FIG. 3 is a perspective diagram illustrating an exemplary configuration of an electromagnetic induction heating device of the image fixing apparatus of FIG. 2.
Figure 4A:
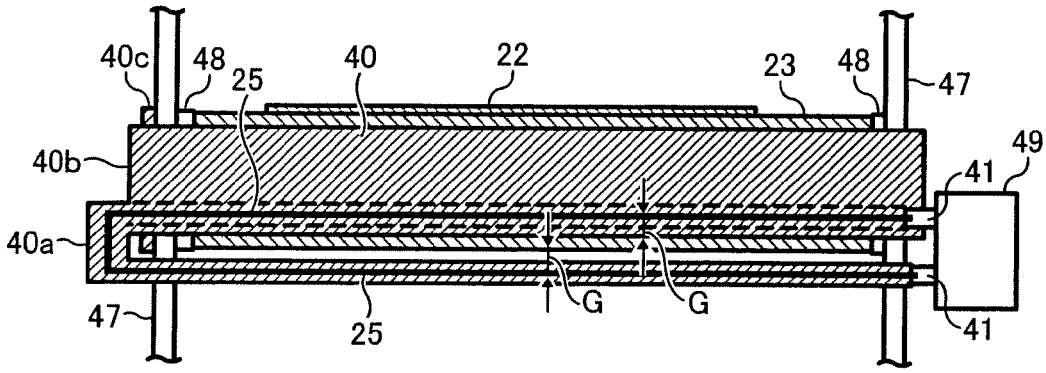
FIG. 4A is a cross-sectional diagram illustrating an exemplary configuration of an electromagnetic induction heating device of the image fixing apparatus of FIG. 2.
Figure 4B:
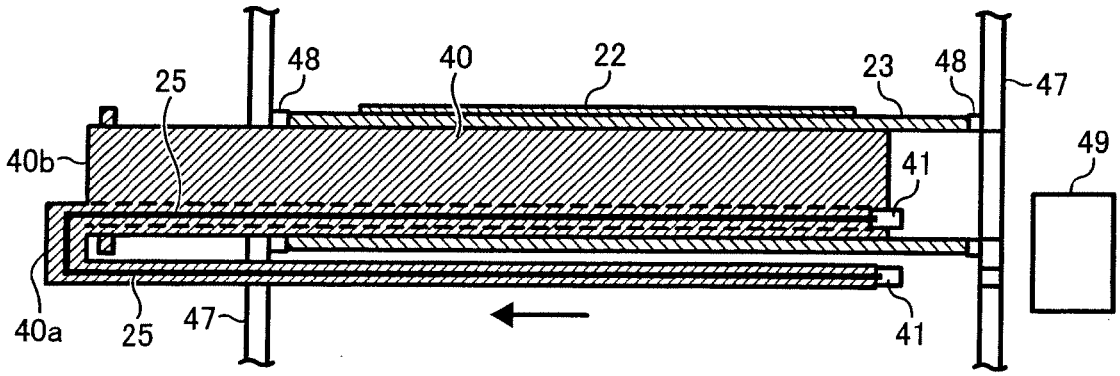
FIG. 4B is also a cross-sectional diagram illustrating an exemplary configuration of an electromagnetic induction heating device of the image fixing apparatus of FIG. 2.
Figure 5:
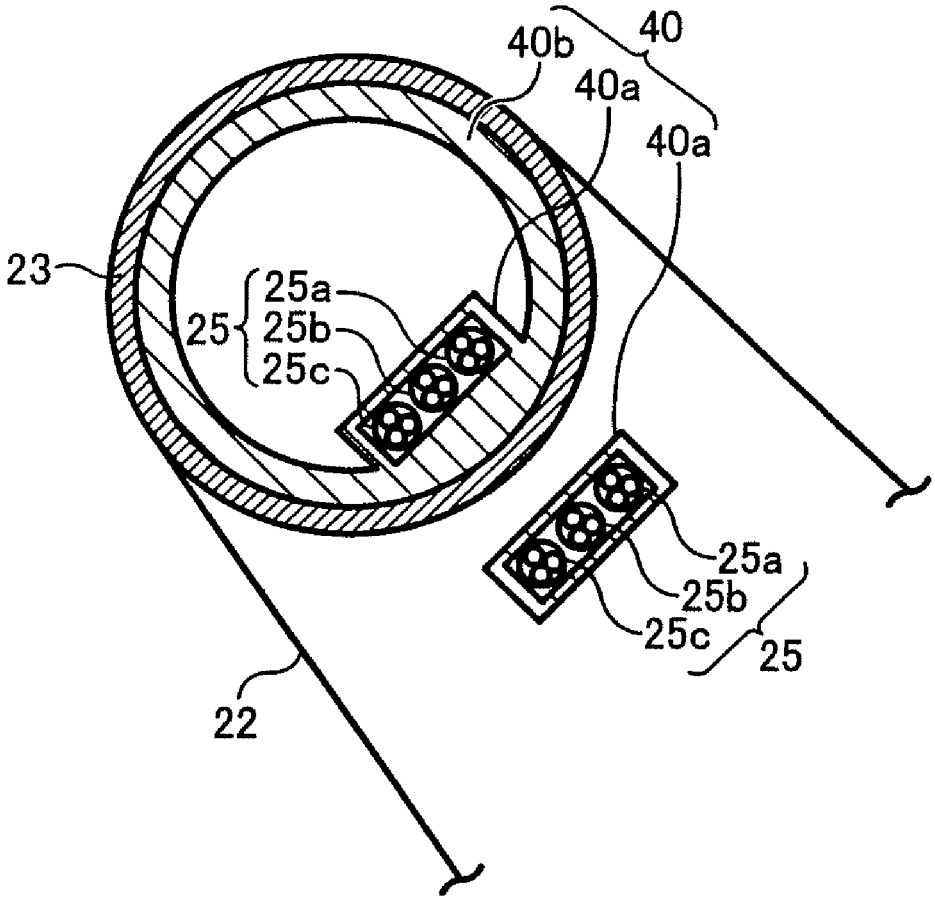
FIG. 5 is a cross-sectional diagram illustrating an exemplary configuration of an electromagnetic induction heating device of the image fixing apparatus of FIG. 2.

First, an exemplary embodiment of the present invention is explained using FIG. 1 through FIG. 6. FIG. 1 is a cross-sectional diagram illustrating an exemplary configuration of an image forming apparatus according to an exemplary embodiment of the present invention. FIG. 2 is a cross-sectional diagram illustrating an exemplary configuration of an image fixing apparatus in the image forming apparatus of FIG. 1. FIG. 3 is a perspective diagram illustrating an exemplary configuration of an electromagnetic induction heating device of the image fixing apparatus of FIG. 2. FIG. 4A is a cross-sectional diagram illustrating an exemplary configuration of an electromagnetic induction heating device of the image fixing apparatus of FIG. 2. FIG. 4B is a cross-sectional diagram illustrating an exemplary configuration of an electromagnetic induction heating device of the image fixing apparatus of FIG. 2. FIG. 5 is a cross-sectional diagram illustrating an exemplary configuration of an electromagnetic induction heating device of the image fixing apparatus of FIG. 2. FIG. 6A is a circuit diagram illustrating an exemplary configuration of connecting an electromagnetic induction heating device with a power source in the image fixing apparatus of FIG. 2. FIG. 6B is a circuit diagram illustrating an exemplary configuration of connecting an electromagnetic induction heating device with a power source in the image fixing apparatus of FIG. 2.

In FIG. 1, a color image forming apparatus 1 includes an exposing device 2, an image fixing apparatus 20, image forming process cartridges 50Y, 50M, 50C, and 50BK which correspond to each color yellow, magenta, cyan, black, respectively, a photo conductor drum 51, a charging device 52, a developing device 53, a transfer bias roller 54, an intermediate transfer belt 57, a cleaner 55, and toner supply devices 56Y, 56M, 56C, and 56BK which correspond to each color yellow, magenta, cyan, black, respectively. The exposing device 2 exposes on the photo conductor drum 51 using laser light according to image data. The image fixing device 20 fixes toner image on a recording medium P with heat by electromagnetic induction heating. The charging device 52 charges the photo conductor drum 51 electrostatically. The developing device 53 develops the electrostatic image on the photo conductor drum 51 into a toner image. The transfer bias roller 54 transfers the toner image onto the intermediate transfer belt 57. The cleaner 55 collects a waste toner on the photo conductor drum 51. The toner supply devices 56Y, 56M, 56C, and 56BK supply toner into the developing devices 53.

The color image forming apparatus 1 further includes a second transfer bias roller 58, an intermediate belt cleaner 59, a transfer belt 60, a sheet cassette 61, an original conveying unit 71, and a scanner device 75. Each color toner image is transferred and layered on the intermediate transfer belt 57. The second transfer bias roller 58 transfers the toner image on the intermediate transfer belt 57 onto the recording medium P. The intermediate belt cleaner 59 collects waste toner on the intermediate transfer belt 57. The transfer belt 60 conveys the recording medium P that has the four color toner image on it. The sheet cassette 61 stores the recording medium P. The original conveying unit 71 conveys an original D into the scanner device 75 that reads image data.

Each image forming process cartridges 50Y, 50M, 50C, and 50BK includes the photo conductor drum 51, the charging device 52, the developing device 53, and the cleaner 55. Each process cartridge 50Y, 50M, 50C, or 50BK is replaced in a predetermined replacement cycle in the color image forming apparatus 1. On each photo conductor drum 51 in the process cartridges 50Y, 50M, 50C, and 50BK, image formation of each color (yellow, magenta, cyan, black) is performed, respectively.

A usual operation at a time of a color image formation in an image forming apparatus is explained. The original D is conveyed in the direction of an arrow in the figure from an original table with the conveyance roller of the original conveying unit 71, and the original D is stacked on a contact glass 73 of the scanner device 75. The scanner device 75 reads image data of the original D on the contact glass 73 optically.

In more detail, the scanner device 75 scans an image of the original D on the contact glass 73 with an irradiated light on the original D. The image formation of a reflected light from the original D is carried out onto a color sensor through a mirror group and a lens. A color picture information of the original D is read for every color separation light of RGB (red, green, blue) by the color sensor. The read information is converted to an electric signal image information. Furthermore, a color conversion process at an image-processing part is carried out based on the level of the color separation image signal of RGB on the strength. Thus, the color picture information of yellow, magenta, cyan, and black are obtained.

The yellow, magenta, cyan, and black color picture information are transmitted to the exposing device 2. From the exposing device 2, the laser light (an exposure light) based on the picture information of each color is emitted towards each photo conductor drum 51 corresponding to the process cartridges 50Y, 50M, 50C and 50BK, respectively.

Each of four photo conductor drums 51 is rotated clockwise in FIG. 1. The surface of each photo conductor drum 51 is charged uniformly at a position opposite of the charging device 52. In this way, an electrification potential is formed on the photo conductor drum 51. The electrified surface of the photo conductor drum 51 reaches the irradiation position of each laser light. In the exposing device 2, the laser light corresponding to the image signal is ejected from a light source corresponding to each color. The laser light penetrates lenses 4 and 5, after reflecting on a polygon mirror 3. After penetrating lenses 4 and 5, the laser light passes each light path for yellow, magenta, cyan, and black.

The laser light corresponding to yellow is reflected by mirrors 6, 7, and 8. The laser light is irradiated onto the photo conductor drum 51 surface of the process cartridge 50Y. At this time, the laser light of yellow is scanned in a direction of an axis of rotation of the photo conductor drum 51 (a main scanning direction) with the polygon mirror 3 which carries out a high velocity revolution. In this way, an electrostatic latent image corresponding to yellow is formed on the photo conductor drum 51 after being charged by the charging device 52.

In similar fashion, the laser light corresponding to magenta is reflected by mirrors 9, 10, and 11. The laser light is irradiated onto the photo conductor drum 51 surface of the process cartridge 50M. An electrostatic latent image corresponding to magenta is formed on the photo conductor drum 51 after being charged by the charging device 52. The laser light corresponding to cyan is reflected by mirrors 12, 13, and 14. The laser light is irradiated onto the photo conductor drum 51 surface of the process cartridge 50C. An electrostatic latent image corresponding to cyan is formed on the photo conductor drum 51 after being charged by the charging device 52. The laser light corresponding to black is reflected by a mirror 15. The laser light is irradiated onto the photo conductor drum 51 surface of the process cartridge 50BK. An electrostatic latent image corresponding to black is formed on the photo conductor drum 51 after being charged by the charging device 52.

The photo conductor drum 51 surface on which the electrostatic latent image of each color is formed reaches a position opposite of the developing device 53, respectively. The toner of each color is supplied to the photo conductor drum 51 from each developing device 53, and the latent image on the photo conductor drum 51 is developed. After a development process, the photo conductor drum 51 surfaces reach a position opposite of the intermediate transfer belt 57, respectively. The transfer bias roller 54 is installed in each opposite position so that it is in contact with an inner surface of the intermediate transfer belt 57. The image of each color formed on the photo conductor drums 51 on the intermediate transfer belt 57 is transferred one by one in a position of the transfer bias roller 54. This is a first transferring process.

After the first transferring process, the photo conductor drum 51 surfaces reach a position opposite to the cleaner 55, respectively. The cleaner 55 collects a waste toner on the photo conductor drum 51. Then, the photo conductor drum 51 surface passes a non-illustrated removing electricity device, and a series of image forming processes on the photo conductor drum 51 are ended.

On the other hand, the intermediate transfer belt 57 surface where the image of each color on the photo conductor drum 51 is transferred in layers runs in the direction of an arrow in the figure, and reaches the position of the second transfer bias roller 58. The full color image on the intermediate transfer belt 57 is secondary transferred on the recording medium P in the position of the second transfer bias roller 58. This is a second transferring process. The intermediate transfer belt 57 surface reaches the position of the intermediate transfer belt cleaner 59. The intermediate transfer belt cleaner 59 collects a waste toner on the intermediate transfer belt 57. A series of image transferring processes on the intermediate transfer belt 57 are ended.

The recording medium P of the second transfer bias roller 58 position is conveyed via a conveyance guide 63, a resist roller 64, etc. from the sheet cassette 61. In more detail, after the sheet paper P fed by the feed roller 62 passes the conveyance guide 63 from the sheet cassette 61 which contains a recording medium P, the sheet paper P is conveyed to the resist roller 64. The recording medium P that has reached the resist roller 64 is conveyed towards the position of the second transfer bias roller 58 with a timing of conveying the toner image on the intermediate transfer belt 57.

After that, the recording medium P on which the full color image is transferred is conveyed to the image fixing apparatus 20 with the transfer belt 60. The recording medium P is conveyed between a fixing belt 22 and a pressing roller 30. The toner image is fixed with heat from the fixing belt 22 and with pressure due to an auxiliary fixing roller 21 and the pressing roller 30. The recording medium P on which the toner image is fixed is output from between the fixing belt 22 and the pressing roller 30, and is discharged as an output image from the color image forming apparatus 1. In this way, a series of image formation processes are completed.

As shown in FIG. 2, the fixing apparatus 20 includes the auxiliary fixing roller 21, the fixing belt 22, a support roller 23, an induction heating device 24, and the pressing roller 30.

The auxiliary fixing roller 21 has an elastic layer 21*b* such as a silicone rubber on the surface of a stainless steel bar 21*a*. The elastic layer 21*b* has a thickness of 3 to 10 mm, and an Asker hardness of 10 to 50 degrees. The auxiliary fixing roller 21 is rotated counterclockwise in FIG. 2 by a non-illustrated driver.

The support roller 23 as a heater is equipped with a heating layer (a cylinder part) which is made of a magnetic conductivity material. A cylinder part of the support roller 23 is formed so that the thickness (a layer thickness) may be set to about 0.6 mm. The support roller 23 rotates counterclockwise in FIG. 2. A coil member 25 is arranged so that it faces an inner and outer surface of the support roller 23. In other words, the support roller 23 that holds intervals is inserted into a loop of the coil member 25

As a material of the support roller 23, magnetic conductive material, for example nickel, iron, chromium, or alloys thereof may be used. In this example, a temperature compensation alloy which has a Curie point higher than a fixing temperature and 300 degrees or less is used as a material of the support roller 23. It may be an alloy of nickel, iron, and chromium, and a desired Curie point may be obtained by adjusting an amount of, and processing conditions of, each material. Thus, the support roller 23 may be formed with a magnetic conductivity material so that it has a Curie point near the fixing temperature of the fixing belt 22. Then, the support roller 23 may be heated by electromagnetic induction without excessive heating. In this example, the support roller 23 only includes a heat layer. But, a reinforcement layer, an elastic layer, a heat insulation layer, etc. may also be provided on the heat layer of the support roller 23.

As shown in FIG. 2, the fixing belt 22 is tensed and supported by the support roller 23 and the auxiliary fixing roller 21. The fixing belt 22 is an endless belt of the multilayer structure where an elastic layer and a releasing layer are formed one by one on a base material. The base material may be made of a heat-resistant insulating resin material such as polyimide, polyamide imide, polyether ether ketone (PEEK), poly ether sulfone (PES), polyphenylene sulfide (PPS), fluoro-resin, etc. The base material has a thickness of 30 to 200 micrometers, considering heat capacity and strength.

The elastic layer of the fixing belt 22 may be made of silicone rubber, fluorosilicone rubber, etc. The elastic layer has a thickness of 50 to 500 micrometers, and an Asker hardness of 5 to 50 degrees. Thereby, an output image of uniform quality without gloss unevenness may be obtained. The releasing layer of the fixing belt 22 may be made of a fluoro-resin, such as polytetraflouroethylene resin (PTFE), perfluoroalkoxy resin (PFA), fluorinated ethylene propylene resin (FEP), etc., or mixtures of these resins, or distributions of these resins in a heat-resistant resin. The releasing layer has a thickness of 5 to 50 micrometers. Thereby, while a characteristic of releasing toner on the fixing belt 22 is obtained, a pliability of the fixing belt 22 is secured.

The induction heating device 24 has a coil member 25 facing the support roller 23, which generates a magnetic flux, and a support member 40, which supports the coil member 25 and the support roller 23. The coil member 25 includes two or more U shaped components 25*a*, 25*b* and 25*c*. The coil member 25 is an excitation coil arranged so that it faces a front and a back side surface of the support roller 23. As shown in FIG. 5, the two or more U-shaped components 25*a*, 25*b* and 25*c* have a twist lines structure in which two or more single insulated lines are bundled mutually. The two or more U-shaped components 25*a*, 25*b* and 25*c* are arranged so that they are parallel to a width direction of the support roller 23. The perimeter of the U-shaped components 25*a*, 25*b* and 25*c* (the coil member 25) is covered with a covering layer (protection layer) which is made of an insulation material.

As shown in FIG. 4, one end of the width direction of the U-shaped components 25*a*, 25*b* and 25*c* of the coil member 25 is a bending part that connects an inner side and an outer side. The other one end of the width direction of the U-shaped components 25*a*, 25*b* and 25*c* of the coil member 25 has a connector 41 that connects a high frequency power supply 49. An alternate current of 10 k-1 MHz is applied to the coil member 25 from the high frequency power supply 49.

The coil member 25 is held with the support member 40 that includes a first support member 40*a* and a second support member 40*b*. In more detail, the first support member 40*a* of the support member 40 is formed in a shape of a loop (a shape of U character) with a hollow structure. The coil member 25 (two or more U-shaped components 25*a*, 25*b* and 25*c*) is held inside of the first support member 40*a* as shown in FIG. 5. The second support member 40*b* is formed in one with the first support member 40*a*. The second support member 40*b* is in contact with an inner side of the support roller 23 and holds the support roller 23 freely in rotation as shown in FIGS. 3 and 4. The composition of the support member 40 determines the position of the coil member 25 to the support roller 23.

The support member 40 is made of heat dissipation parts which radiates the heat produced in the coil member 25. In this example, the support member 40 (the first support member 40*a* and the second support member 40*b*) is formed by a highly thermally-conductive material which has heat resistance. The thermal conductivity of this highly thermally-conductive material may be set up so that it may become higher than the thermal conductivity of the covering layer (mainly formed with a resin) which covers the coil member 25. Therefore, a heat produced in the coil member 25 will be positively released from the support member 40 which functions as a heat dissipation device.

As a highly thermally-conductive material which forms the support member 40 as a heat dissipation device, non-magnetic metal such as aluminum, copper, etc. is suitable in consideration of an influence on magnetic flux which acts on the support roller 23. A temperature of the coil member 25 reaches about 160-180 degrees C. at the time of continuation feeding sheets. Based on the inventor's experiments about 200 degrees C. of heat-resistant temperature of the support member 40 is needed. The above-mentioned material satisfies this condition. As a highly thermally-conductive material which forms the support member 40, an engineering plastic or a super engineering plastic, such as an alumina, silicon nitride, silicon carbide, polyphenylene sulfide resin (PPS), PPS resin containing a glass filler, polyether ether ketone resin (PEEK), polyamide imide resin (PAI), polyimide resin (PI), fluoro-resin, etc. may also be used.

As shown in FIG. 3, the support member 40 as a heat dissipation part is formed so that the range of the width direction may include the range of the width direction of the support roller 23 (exothermic component). That is, the support member 40 is formed so that the length of the width direction may be longer than the length of the width direction of the support roller 23 and both ends of the support member 40 may be exposed. Heat dissipation is enough with this configuration and the heat dissipation to the coil member 25 with the support member 40 may be increased. Furthermore, the support member 40 as a heat dissipation part is provided so that at least part may not be surrounded with the support roller 23. In this example, an outside surface of the first support member 40*a* and both ends of the support member 40 are exposed without being surrounded by the support roller 23. Heat dissipation is enough with this configuration and the heat dissipation to the coil member 25 with the support member 40 may be increased.

In addition, a low friction material may be applied to the perimeter side of the second support member 40*b* of the support member 40. For example, coating of the fluoro-resin which has heat resistance may be carried out on the perimeter side of the second support member 40*b*, or fluoride grease may be applied. By this, a frictional resistance in case the support roller 23 revolves around the second support member 40*b* may be reduced.

Thus, the support member 40 defines a position of the coil member 25 to the support roller 23 (heating component) as an exothermic component. That is, positioning of the coil member 25 to the support roller 23 is carried out by the first support member 40*a* united with the second support member 40*b* included in the support roller 23. As shown in FIG. 4A, a gap G between the coil member 25 and an inner surface of the support roller 23 and a gap G between the coil member 25 and an inner surface of the support roller 23 has a length of 0.5 to 50 mm.

As shown in FIGS. 4A and 4B, the support member 40 is supported with two side boards 47 fixed on both ends of the image fixing apparatus 20 in a width direction. By this, a position of the support roller 23 in the image fixing apparatus 20 and the coil member 25 may also be settled. The connector 41 held by the support member 40 is connected to a connector of the high frequency power supply 49 fixed at the back side (it is on the right-hand side of FIGS. 4A and 4B) of a width direction. Turning on electricity in the coil member 25 from the high frequency power supply 49 is attained.

Figure 6A:
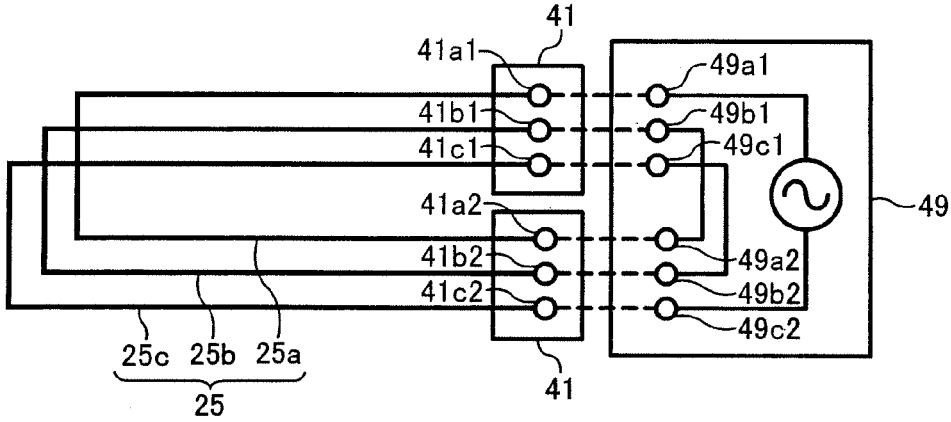
FIG. 6A is a circuit diagram illustrating an exemplary configuration of connecting an electromagnetic induction heating device with a power source in the image fixing apparatus of FIG. 2.

A path of an alternate current applied to the coil member 25 which includes three U-shaped components 25*a*, 25*b* and 25*c* is explained. As shown in FIG. 6A, in this example, each terminal of three U-shaped components 25*a*, 25*b* and 25*c* is independently arranged at two connectors 41. For example, one side of the connectors 41 has one terminal 41*a*1 of the first U-shaped component 25*a*, one terminal 41*b*1 of the second U-shaped component 25*b*, and one terminal 41*c*1 of the third U-shaped component 25*c*. The other side of the connectors 41 has one terminal 41*a*2 of the first U-shaped component 25*a*, one terminal 41*b*2 of the second U-shaped component 25*b*, and one terminal 41*c*2 of the third U-shaped component 25*c*.

The terminals 41*a*1, 41*b*1, and 41*c*1 of one side of the connectors 41 are connected to terminals 49*a*1, 49*b*1, and 49*c*1 of the high frequency power supply 49, respectively. The terminals 41*a*2, 41*b*2, and 41*c*2 of the other side of the connectors 41 are connected to terminals 49*a*2, 49*b*2, and 49*c*2 of the high frequency power supply 49, respectively. In the high frequency power supply 49, the terminal 49*b*1 and the terminal 49*a*2 are connected, the terminal 49*c*1 and the terminal 49*b*2 are connected, and the terminal 49*a*1 and the terminal 49*c*2 are connected to the alternate current power supply. Then, one path of alternate current is formed in the coil member 25 connected to the high frequency power supply 49. Therefore, an alternate magnetic field with a sufficient efficiency may be obtained by the three U-shaped components 25*a*, 25*b*, and 25*c* using one alternate current power supply.

Figure 6B:
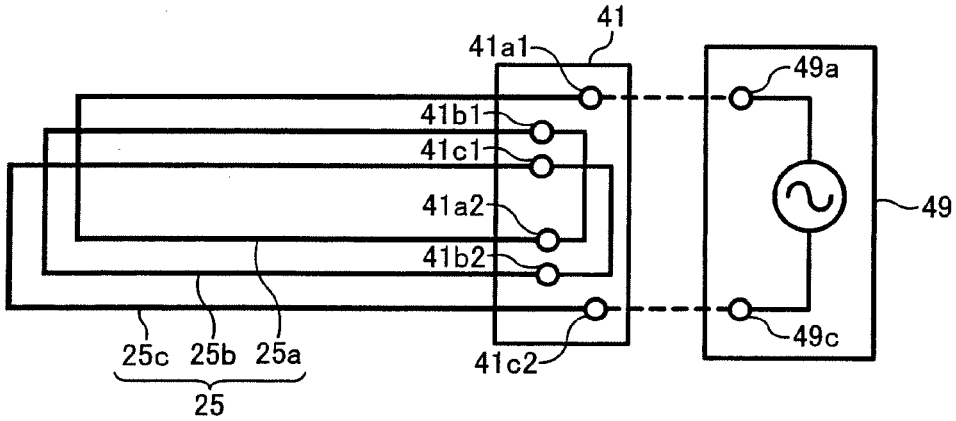
FIG. 6B is a circuit diagram illustrating an exemplary configuration of connecting an electromagnetic induction heating device with a power source in the image fixing apparatus of FIG. 2.

In this example, two connectors 41 are installed in the support member 40. But, it is also possible to install one connector 41 in the support member 40. For example, as shown in FIG. 6B, two input-and-output terminals 41*a*1 and 41*c*2 are installed in the connector 41 held with the support member 40. The two input-and-output terminals are one terminal 41*a*2 of the first U-shaped component 25*a*, and the terminal 41*c*2 of the other side of the third U-shaped component 25*c*, respectively. These two input-and-output terminals 41*a*1 and 41*c*2 are connected to two terminals 49*a* and 49*c* of the high frequency power supply 49. In the connector 41, one terminal 41*b*1 of the second U-shaped component 25*b* and the terminal 41*a*2 of the other side of the first U-shaped component 25*a* are connected and one terminal 41*c*1 of the third U-shaped component 25*c* and the terminal 41*b*2 of the other side of the second U-shaped component 25*b* are connected. Then, one path of alternate current is formed in the coil member 25 connected to the high frequency power supply 49. Therefore, an alternate magnetic field with a sufficient efficiency may be obtained by the three U-shaped components 25*a*, 25*b*, and 25*c* using one alternate current power supply.

As shown in FIG. 2, the pressing roller 30 has an elastic layer 30*b* such as fluoride rubber, silicone rubber, etc. on the surface of a bar 30*a* that includes aluminum, copper, etc. The elastic layer 30*b* has a thickness of 1 to 5 mm, and an Asker hardness of 20 to 50 degrees. The pressing roller 30 pushes the auxiliary fixing roller 21 through the fixing belt 22 (fixing component). The recording medium P is conveyed into a nip press region between the fixing belt 22 and the pressing roller 30.

A thermo-sensitive register is in contact with an outer surface of the fixing belt 22 upstream of the fixing nip press region. A temperature of the fixing belt 22 surface (fixing temperature) is detected with the thermo-sensitive register, and the output of the induction-heating device 24 is adjusted.

The fixing apparatus 20 operates as follows. The fixing belt 22 as a fixing component rotates in the direction of the arrow in FIG. 2 with rotation of the auxiliary fixing roller 21. The support roller 23 as an exothermic component (heating component) also rotates counterclockwise in FIG. 2. The pressing roller 30 also rotates in the direction of the arrow. The fixing belt 22 is heated at a position of the support roller 23.

In more detail, a 10 kHz-1 MHz high frequency alternate current is applied to the coil member 25 from the high frequency power supply 49. A line of magnetic force may be formed so that it changes by turns bi-directionally into the U-shaped part of the coil member 25 (inside of the loop). With the magnetic field being formed, when the temperature of the support roller 23 is below a Curie point, an eddy current arises on the support roller 23 surface. Heat occurs and the support roller 23 is heated according to the resistance of the support roller 23. In this way, the fixing belt 22 is heated by the heat received from the heated support roller 23. Therefore, in this example, the support roller 23 as an exothermic component will also function as a heating component.

After, the fixing belt 22 surface heated with the coil member 25 passes through the position of the thermo sensitive register, and reaches a contact point with the pressing roller 30. Then, the toner image T on the recording medium P is heated to be melted. In more detail, the recording medium P is guided with a guide board (it is not illustrated), and it is conveyed between the fixing belt 22 and the pressing roller 30 (it is a movement of the conveyance direction of the arrow Y). The toner image T on a recording medium P is fixed with the heat received from the fixing belt 22 and the pressure from the pressing roller 30. The recording medium P is output from between the fixing belt 22 and the pressing roller 30.

The fixing belt 22 surface passed through the position of the pressing roller 30 reaches the position of the support roller 23 again. Such a series of operations is repeated continuously, and the fixing process in an image formation process is completed.

In the fixing process, when the temperature of the support roller 23 exceeds a Curie point, generation of heat of the support roller 23 may be restricted. That is, when the temperature of the support roller 23 heated with the induction-heating device 24 exceeds a Curie point, the support roller 23 may lose magnetism. Then, generation of an eddy current near the surface is restricted. Therefore, the amount of heat generated in the support roller 23 falls, and an excessive temperature may be controlled.

Such self-temperature control capability especially increases when the coil member 25 is arranged in the shape of a loop (the shape of a U) to the exothermic component 23 like this example as compared to a case in which the coil member 25 is arranged at one side (outside) of the exothermic component 23.

As shown in FIGS. 4A and 4B, an operation of the induction-heating device (induction-heating unit) 24 is explained. FIG. 4A is a cross-sectional diagram illustrating an exemplary configuration of an electromagnetic induction heating device in a width direction attached to the image fixing apparatus 20 of the image fixing apparatus of FIG. 2. FIG. 4B is a cross-sectional diagram illustrating an exemplary configuration of an electromagnetic induction heating device in a width direction in a case of being attached or detached to the image fixing apparatus 20 of FIG. 2.

As shown in FIGS. 4A and 4B, the induction-heating device 24 is installed so that it may freely attach or detach through the end side (left-hand side of FIG. 4A) of the width direction of the support roller 23. That is, when carrying out detachment of the induction-heating member 24 that includes the coil member 25 and the support member 40 from the image fixing apparatus 2, it is operated in the direction of the arrow of FIG. 4B.

A brim part 40*c* is provided at the end of the support member 40. When the induction-heating device 24 is attached to the image fixing apparatus 20, a contact between the brim part 40*c* and the side board 47 determines a position of the induction-heating device 24 to the image fixing apparatus 20 in the width direction. A spacer 48 is installed between the side board 47 and the support roller 23. This determines a position of the support roller 23 to the image fixing apparatus 20 in the width direction.

Thus, the induction-heating device 24 may be easily detached and attached from the fixing belt 22 that has comparatively frequent opportunities for maintenance. Then, a working efficiency of a worker at the time of maintenance (or the time of assembling) may improve. When a user maintains the fixing apparatus 20, a composition of this example may become useful especially.

In the image fixing apparatus 20 of an electromagnetic induction heating system, the coil member 25 is arranged so that it faces a front and a back side surface of the support roller 23 that has a Curie point near the fixing temperature. Thereby, the capability for self-temperature control in the support roller 23 may increase. Therefore, when recording medium having a small size is fixed continuously, or when a driving of the apparatus suddenly stops, an excessive temperature of the fixing belt 22 may be controlled. The coil member 25 is a unit with the support member 40 which holds the coil member 25 and defines the position to the support roller 23. Thereby, a high heating efficiency to the support roller 23 is maintained stably, and an assembling and an maintenance efficiency of the image fixing apparatus 20 may increase. The support member 40 is formed by a highly thermally-conductive material, and all of the support member 40 is a heat dissipation part. Thereby, the rise in temperature of the coil member 25 is reduced, and loss of the power consumption of the fixing apparatus 20 may be lessened.

In this example, although the coil member 25 includes two or more U-shaped components 25*a*, 25*b*, and 25*c*, the coil member 25 may include a single U-shaped component. The two or more U-shaped components 25*a*, 25*b* and 25*c* have a twist lines structure in which two or more single insulated lines are bundled mutually. The two or more U-shaped components 25*a*, 25*b* and 25*c* also may have a single line structure that is manufactured by drawing-out processing, etc. The coil member 25 may wind a plurality of times around a front and back surface of the support roller 23. In these cases, the efficiency may be maintained the same as the above-mentioned example.

In this example, the heat dissipation part which releases the heat produced in the coil member is formed with a highly thermally-conductive material. The heat dissipation part may also have a heat pipe. This case also has an efficiency as same as the above-mentioned example.

Figure 7:
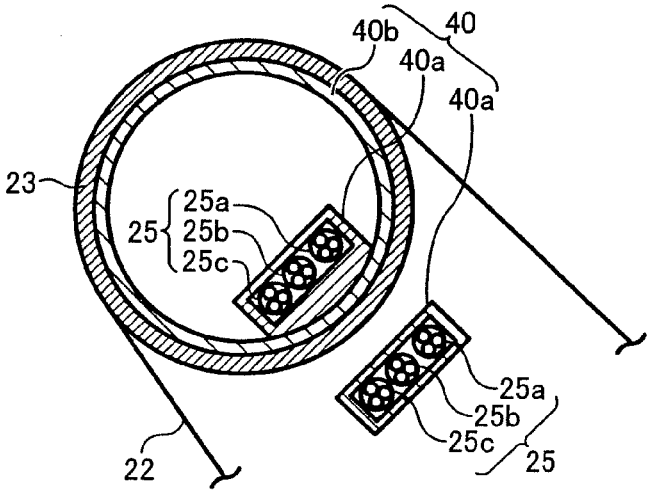
FIG. 7 is a cross-sectional diagram illustrating another exemplary configuration of an electromagnetic induction heating device of the image fixing apparatus of FIG. 2.
Figure 8:
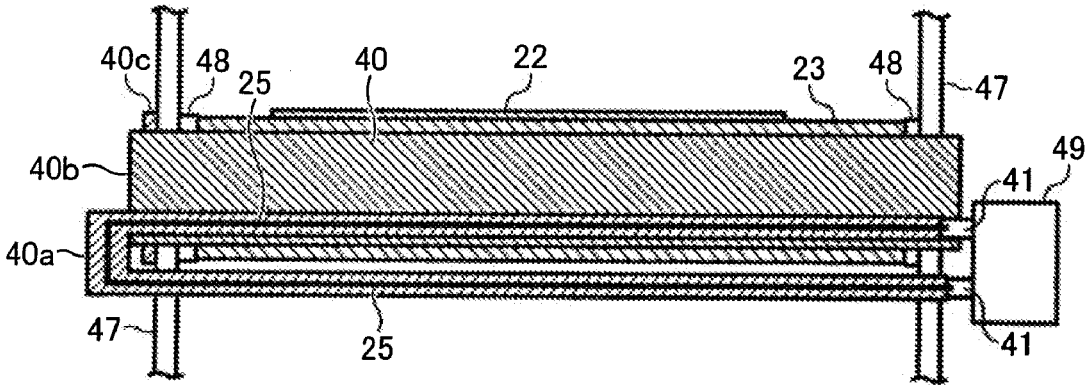
FIG. 8 is a cross-sectional diagram illustrating an exemplary configuration of an electromagnetic induction heating device of the image fixing apparatus of FIG. 2.

FIG. 7 is a cross-sectional diagram illustrating an another exemplary configuration of an electromagnetic induction heating device of the image fixing apparatus of FIG. 2. FIG. 8 is also a cross-sectional diagram illustrating an exemplary configuration of an electromagnetic induction heating device of the image fixing apparatus of FIG. 2. In this example, a heat insulation member 40*b* is provided in the support member 40, which is different from the above-mentioned example.

As shown in FIGS. 7 and 8, in the fixing apparatus 20, the support member 40 includes a heat dissipation part which releases a heat produced in the coil member 25. The other part of the support member 40 includes a heat insulation part which intercepts the heat input into the coil member 25. The first support member 40*a* of the support member 40 is formed with a highly thermally-conductive material. The second support member 40*b* of the support member 40 is formed with a thermal insulation material that has heat resistance. Therefore, the first support member 40*a* may function as a heat dissipation part, and the second support member 40*b* may function as a heat insulation part.

That is, the heat produced in the coil member 25 is released outside through the first support member 40*a* which functions as a heat dissipation part. The most radiant heat which moves towards the coil member 25 from the support roller 23 is intercepted by the second support member 40*b* as a heat insulation part. Therefore, the increase in temperature of the coil member 25 is reduced further, and loss of the power consumption of the fixing apparatus 20 may be lessened further.

In the image fixing apparatus 20 of an electromagnetic induction heating system, the coil member 25 is arranged so that it faces a front and a back side surface of the support roller 23 and the support member 40 includes the heat dissipation part 40*a* and the heat insulation part 40*b*. Thereby, the capability for self-temperature control in the support roller 23 may increase. Therefore, when a recording medium having a small size is fixed continuously, or when a driving of the apparatus suddenly stops, an excessive temperature of the fixing belt 22 may be controlled. Also, a high exothermic efficiency may be maintained stably and a loss of power consumption may be lessened.

Figure 9:
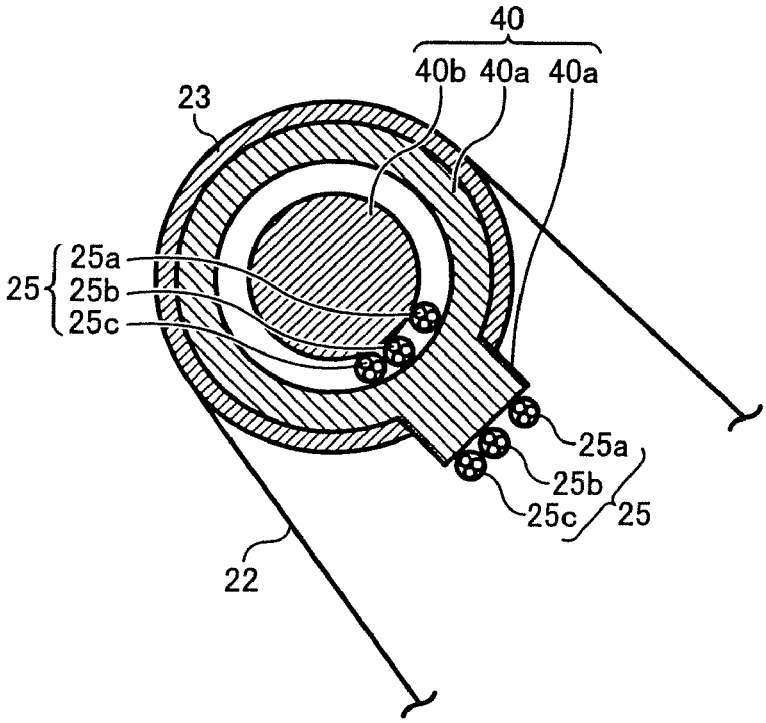
FIG. 9 is a cross-sectional diagram illustrating another exemplary configuration of an electromagnetic induction heating device of the image fixing apparatus of FIG. 2.
Figure 10:
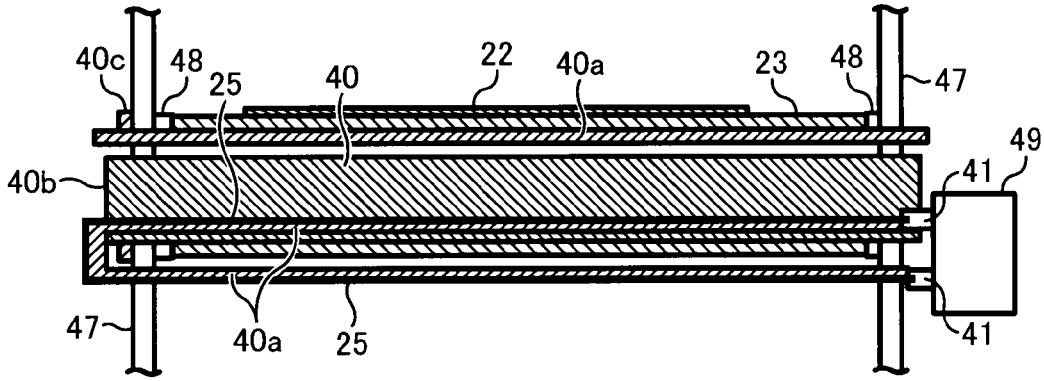
FIG. 10 is a cross-sectional diagram illustrating an exemplary configuration of an electromagnetic induction heating device of the image fixing apparatus of FIG. 2.

FIG. 9 is a cross-sectional diagram illustrating an another exemplary configuration of an electromagnetic induction heating device of the image fixing apparatus of FIG. 2. FIG. 10 is also a cross-sectional diagram illustrating an exemplary configuration of an electromagnetic induction heating device of the image fixing apparatus of FIG. 2. In this example, a structure of the support member 40 is different from the above-mentioned example.

As shown in FIGS. 9 and 10, the support member 40 of the image fixing apparatus 20 includes a heat dissipation part and a heat insulation part. A first support member 40*a* of the support member 40 has a loop shape and supports the coil member 25 so that it contacts an inner side of the support roller 23 and supports the support roller 23 that it may rotate freely. The first support member 40*a* is formed with thermal insulation material which has heat resistance, and functions as the heat insulation part. A second support member 40*b* and the first support member 40*a* of the support member 40 supports an inner side of the coil member 25. The second support member 40*b* is formed with highly thermally-conductive material, and functions as the heat dissipation part.

That is, the heat produced in the coil member 25 is released outside through the second support member 40*b* which functions as a heat dissipation part. Most of a radiant heat which moves towards the coil member 25 from the support roller 23 may be insulated with the first support member 40*a* as the heat insulation part. Therefore, the increase of temperature in the coil member 25 may be controlled further, and a loss of the power consumption of the image fixing apparatus 20 may be also reduced further.

In the image fixing apparatus 20 of an electromagnetic induction heating system, the coil member 25 is arranged so that it faces a front and a back side surface of the support roller 23. The second support member 40*b* as a heat dissipation part and the first support member 40*a* as a heat insulation part are provided in the support member 40 which holds the coil member 25 and defines the position to the support roller 23. Thereby, the capability of the self-temperature control in the support roller 23 may increase. Therefore, when a recording medium having a small size is fixed continuously, or when a driving of the apparatus suddenly stops, an excessive temperature of the fixing belt 22 may be controlled. Also, a high exothermic efficiency may be maintained stably and a loss of power consumption may be lessened.

Figure 11:
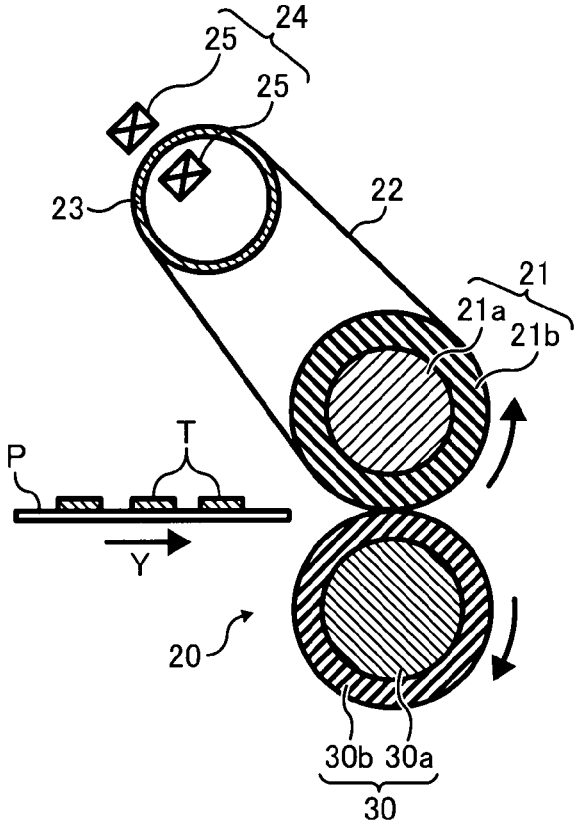
FIG. 11 is a cross-sectional diagram illustrating another exemplary configuration of an image fixing apparatus in the image forming apparatus of FIG. 1.
Figure 12A:
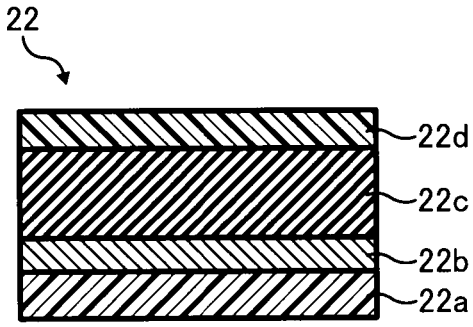
FIG. 12A is a cross-sectional diagram illustrating an exemplary configuration of a part of a fixing belt in the image fixing apparatus of FIG. 11.
Figure 12B:
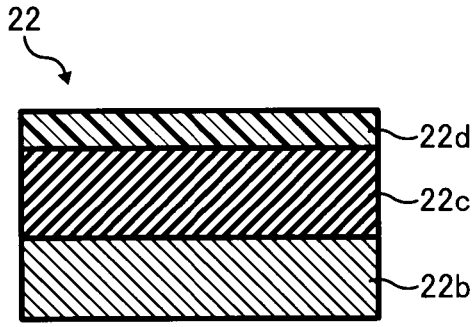
FIG. 12B is a cross-sectional diagram illustrating an exemplary configuration of a part of a fixing belt in the image fixing apparatus of FIG. 11.
Figure 12C:
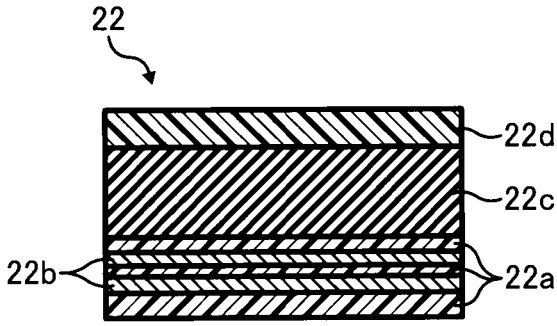
FIG. 12C is a cross-sectional diagram illustrating an exemplary configuration of a part of a fixing belt in the image fixing apparatus of FIG. 11.
Figure 12D:
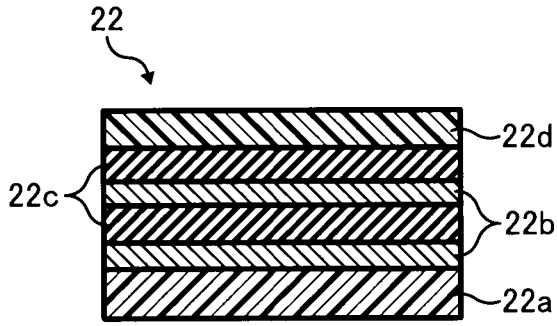
FIG. 12D is a cross-sectional diagram illustrating an exemplary configuration of a part of a fixing belt in the image fixing apparatus of FIG. 11.

FIG. 11 is a cross-sectional diagram illustrating another exemplary configuration of an image fixing apparatus in the image forming apparatus of FIG. 1. FIG. 12A is a cross-sectional diagram illustrating an exemplary configuration of a part of a fixing belt in the image fixing apparatus of FIG. 11. FIG. 12B is also a cross-sectional diagram illustrating an exemplary configuration of a part of a fixing belt in the image fixing apparatus of FIG. 11. FIG. 12C is also a cross-sectional diagram illustrating an exemplary configuration of a part of a fixing belt in the image fixing apparatus of FIG. 11. FIG. 12D is also a cross-sectional diagram illustrating an exemplary configuration of a part of a fixing belt in the image fixing apparatus of FIG. 11. This image fixing apparatus is different from the above-mentioned image fixing apparatus so that the coil member 25 may counter the front and back sides of the support roller 23 and the fixing belt 22.

As shown in FIG. 11, the coil member 25 is located at the support roller 23 that holds the fixing belt 22. The coil member 25 may be faced to the front and back sides of the support roller 23 and the fixing belt 22 and may be extended in a width direction. The induction heating device 24 that includes the coil member 25 is provided to the image fixing apparatus 20 so that it may be detachable. In the image fixing apparatus 20, it has a same structure as the above-mentioned example except for a position of the coil member 25.

The fixing belt 22 has a heat layer. As shown in FIG. 12A, the fixing belt 22 is an endless belt of a multilayer structure where a heat layer 22*b*, an elastic layer 22*c* and a releasing layer 22*d* are formed one by one on a base 22*a*. The base 22*a* may be made of a heat-resistant insulating resin material, for example, polyimide, polyamide-imide, PEEK, PES, PPS, fluoro-resin, etc. The base 22*a* has a thickness of 30 to 200 micrometers in consideration of a heat capacity and a strength.

The heat layer 22*b* of the fixing belt 22 may be made of a magnetic conductivity material, and the heat layer 22*b* has a thickness of 1 to 20 micrometers. The heat layer 22*b* may be is formed by plating, sputtering, a vacuum deposition, etc. on the base 22*a*. A magnetic conductive material, for example, nickel or stainless steel may be used as a material of the heat layer 22*b*. In this example, a temperature compensation alloy which has a Curie point higher than a fixing temperature 300 degrees or less is used as a material of the heat layer 22*b*. It may be an alloy of nickel, iron, and chromium, and a desired Curie point may be obtained by adjusting an amount of, and processing conditions of, each material. Thus, the heat layer 22*b* may be formed with a magnetic conductivity material so that it has a Curie point near the fixing temperature of the fixing belt 22. Then, the heat layer 22*b* may be heated by an electromagnetic induction without excessive heating.

The elastic layer 22*c* of the fixing belt 22 may be made of a silicone rubber, a fluorosilicone rubber, etc. The elastic layer has a thickness of 50 to 500 micrometers, and an Asker hardness of 5 to 50 degrees. Thereby, an output image of uniform quality without gloss unevenness may be obtained.

The releasing layer 22*d* of the fixing belt 22 is made of a fluoro-resin such as polytetraflouroethylene resin (PTFE), perfluoroalkoxy resin (PFA), fluorinated ethylene propylene resin (FEP), etc., or a mixture of these resins, or a distribution of these resins in a heat-resistant resin. The releasing layer 22*d* has a thickness of 5 to 50 micrometers. Thereby, while a characteristic of releasing toner on the fixing belt 22 is obtained, a pliability of the fixing belt 22 is secured. A primer layer etc. may also be provided between each layer 22*a*, 22*b*, 22*c*, and 22*d* of the fixing belt 22.

As shown in FIG. 12A, the fixing belt 22 includes four layers. As shown in FIGS. 12B, 12C, and 12D, they may have other structures. As shown in FIG. 12B, the fixing belt 22 includes a heat layer 22*b*, an elastic layer 22*c*, and a releasing layer 22*d*. The heat layer 22*b* of the fixing belt 22 may be made of a fluoro-resin such as polyimide, polyamide-imide, PEEK, PES, PPS, fluoro-resin, etc., or these resins including distributed magnetic conductivity particles. In this case, the resin includes the magnetic conductivity particles with a 20 to 90 weight percent. For example, the magnetic conductivity particles are distributed in the resin of a varnish state with a distributing machine such as a roll mill, a sand mill, a centrifugal mixer, etc. A desired layer thickness is obtained with a metallic mold adjusting a viscosity of a solvent.

As shown in FIG. 12C, the fixing belt 22 includes two or more heat layers 22*b* in the base 22*a*, and forms an elastic layer 22*c* and a releasing layer 22*d* one by one on it. As shown in FIG. 12D, the fixing belt 22 forms an elastic layer 22*c* with two or more heat layers 22*b* on a base 22*a*, and further forms a releasing layer 22*d* as a surface layer. This fixing belt 22 has a same effect as following example.

The coil member 25 is arranged so that it faces a front and a back side surface of the support roller 23 and the heat layer 22*b*. The second support member as a heat dissipation part and the first support member as a heat insulation part are provided in the support member which holds the coil member 25 and defines the position to the support roller 23 and the heat layer 22*b*. Thereby, the capability of the self-temperature control in the support roller 23 may increase. Therefore, a high exothermic efficiency may be maintained stably and a loss of power consumption may be lessened.

The image fixing apparatus 20 operates as follows. With a rotation of the auxiliary fixing roller 21, the fixing belt 22 rotates in the direction of an arrow in FIG. 11. The support roller 23 also rotates counterclockwise. The pressing roller 30 also rotates in the direction of the arrow. The fixing belt 22 is heated in an opposite position with the coil member 25.

In more detail, a 10 kHz-1 MHz high frequency alternate current is applied to the coil member 25 from the high frequency power supply 49. A line of magnetic force may be formed so that it changes by turns bi-directionally into the loop part of the coil member 25. With the magnetic field being formed, when the temperature of the support roller 23 and the heat layer 22*b* is below a Curie point, an eddy current arises on the surface of the support roller 23 and the heat layer 22*b*. Heat occurs and the support roller 23 is heated according to the resistance of the support roller 23 and the heat layer 22*b*. In this way, the fixing belt 22 is heated by the heat received from the heated support roller 23 and the heat of the heat layer 22*b*.

After that, the fixing belt 22 surface heated with the coil member 25 passes through the position of a thermo-sensitive register and reaches a contact point with the pressing roller 30. Then, the conveyed toner image T on the recording medium P is heated and fixed.

After the fixing belt 22 surface passes through the position of the pressing roller 30, it reaches a position opposite the coil member 25 again. Such a series of operations is repeated continuously, and the fixing process in the image formation process is completed.

In the fixing process, when the temperature of the support roller 23 and the heat layer 22*b* exceeds a Curie point, generation of heat of the support roller 23 and the heat layer 22*b* may be restricted. That is, when the temperature of the support roller 23 and the heat layer 22*b* heated with the induction-heating device 24 exceeds a Curie point, the support roller 23 and the heat layer 22*b* may lose magnetism. Then, generating of the eddy current near the surface is restricted. Therefore, the amount of generating of the heat in the support roller 23 and the heat layer 22*b* falls, and an excessive temperature may be controlled.

In the image fixing apparatus 20 of an electromagnetic induction heating system, the coil member 25 is arranged so that it faces a front and a back side surface of the support roller 23 and the heat layer 22*b*. A heat dissipation part is provided in the support member which holds the coil member 25 and defines the position to the support roller 23 and the fixing belt 22. Thereby, the capability of the self-temperature control in the support roller 23 and the heat layer 22*b* may increase. Therefore, when a recording medium having a small size is fixed continuously, or when a driving of the apparatus suddenly stops, an excessive temperature of the fixing belt 22 may be controlled. Also, a high exothermic efficiency may be maintained stably and a loss of power consumption may be lessened.

In the example, the fixing belt 22 which has the heat layer 22*b*, and the support roller 23 which has an exothermic layer are used as an exothermic member. On the other hand, only one of them may be used as an exothermic member. In this case, there is a same effect as the above-mentioned example.

Figure 13:
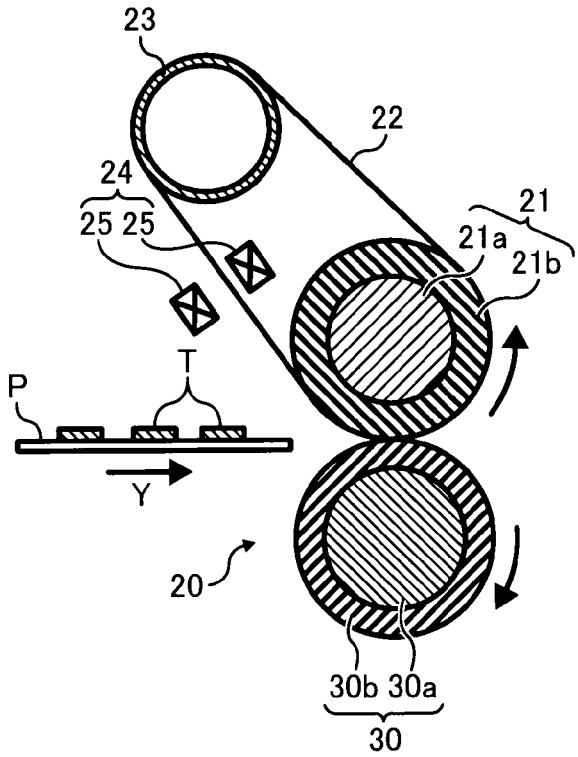
FIG. 13 is a cross-sectional diagram illustrating another exemplary configuration of an image fixing apparatus in the image forming apparatus of FIG. 1.

FIG. 13 is a cross-sectional diagram illustrating another exemplary configuration of an image fixing apparatus in the image forming apparatus of FIG. 1. This image fixing apparatus is different from the above-mentioned image fixing apparatus so that the coil member 25 may counter the front and back sides of the fixing belt 22.

As shown in FIG. 13, the coil member 25 is located at the fixing belt 22 and not located at the support roller 23 or the auxiliary fixing roller 21. The coil member 25 may be faced to the front and back sides of the fixing belt 22 and may be extended in a width direction. The induction heating device 24 that includes the coil member 25 is provided to the image fixing apparatus 20 so that it may be detachable. In the image fixing apparatus 20, it has the same structure as the above-mentioned example except for a position of the coil member 25. Also a heat layer is not provided in the support roller 23. The fixing belt 22 includes a heat layer 22*b* similar to the above-mentioned example.

The coil member 25 is arranged so that it faces a front and a back side surface of the fixing belt 22. A heat dissipation part is provided in the support member which holds the coil member 25 and defines the position to the fixing belt 22. Thereby, the capability of temperature control in the coil member 25 may increase. Therefore, a high exothermic efficiency may be maintained stably and a loss of power consumption in the image fixing apparatus 20 may be lessened.

In the fixing apparatus 20, with turning on electricity, the coil member 25 generates a magnetic flux and heats the fixing belt 22. That is, a line of magnetic force is formed in the loop of the coil member 25 with alternate current being supplied to the coil member 25. Further, the heat layer 22*b* of the fixing belt 22 is heated by an electromagnetic induction. The heated fixing belt 22 heats and fixes a toner image on the recording medium P conveyed along the direction of an arrow Y.

In the image fixing apparatus 20 of this example, the coil member 25 is arranged so that it faces a front and a back side surface of the fixing belt 22. A heat dissipation part is provided in the support member which holds the coil member 25 and defines the position to the fixing belt 22. Thereby, the capability of the self-temperature control in the heat layer 22*b* may increase. Therefore, when the recording medium having a small size is fixed continuously, or when a driving of the apparatus suddenly stops, an excessive temperature of the fixing belt 22 may be controlled. Also, a high exothermic efficiency may be maintained stably and a loss of power consumption may be lessened.

Figure 14:
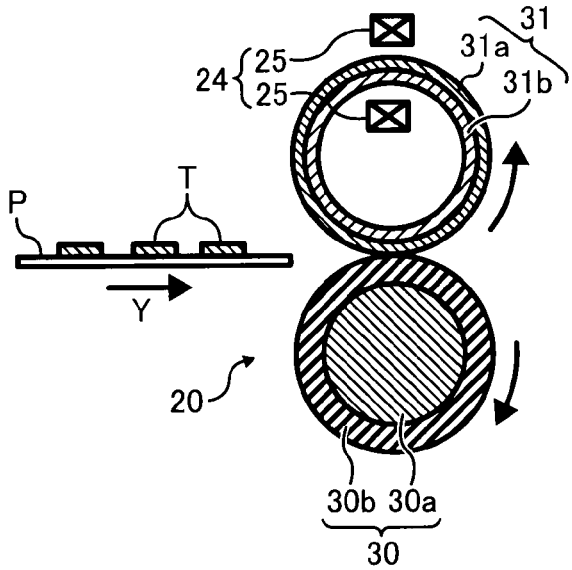
FIG. 14 is a cross-sectional diagram illustrating another exemplary configuration of an image fixing apparatus in the image forming apparatus of FIG. 1.

FIG. 14 is a cross-sectional diagram illustrating another exemplary configuration of an image fixing apparatus in the image forming apparatus of FIG. 1. This image fixing apparatus is different from the above-mentioned image fixing apparatus so that a fixing roller 31 is used as an exothermic component.

A image fixing apparatus 20 mainly includes a fixing roller 31 (fixing component) as an exothermic component, a pressing roller 30, and induction-heating device 24. In the fixing roller 31, a temperature compensation alloy which has a Curie point higher than a fixing temperature and 300 degrees or less is used as a heat layer 31*b*. The fixing roller 31 also includes an elastic layer 31*a* such as a silicone rubber, and a releasing layer such as a fluorine compound.

The induction-heating device 24 includes the coil member 25 facing a front and a back side surface of the fixing roller 31, and a support member of the coil member 25, which determines the position of the coil member 25. The induction-heating device 24 is provided so that it is detachable from one end of the image fixing apparatus 20.

The coil member 25 is arranged so that it faces a front and a back side surface of the fixing roller 31. A heat dissipation part is provided in the support member which holds the coil member 25 and defines the position to the fixing roller 31. Thereby, the capability of temperature control in the coil member 25 may increase. Therefore, a high exothermic efficiency may be maintained stably and a loss of power consumption in the image fixing apparatus 20 may be lessened.

In the fixing apparatus 20, a 10 k-1 MHz alternate current is supplied to the coil member 25, a line of magnetic force is formed in the loop of the coil member 25. The fixing roller 31 is heated by an electromagnetic induction. The heated fixing roller 31 heats and fixes a toner image on the recording medium P conveyed along the direction of an arrow. When the temperature of the heat layer 31*b* of the fixing roller 31 exceeds a Curie point, heating of the heat layer 31*b* will be efficiently restricted like the above-mentioned example.

In the image fixing apparatus 20 of this example, the coil member 25 is arranged so that it faces a front and a back side surface of the fixing roller 31. A heat dissipation part is provided in the support member which holds the coil member 25 and defines the position to the fixing roller 31. Thereby, the capability of the self-temperature control in the heat layer 31*b* of the fixing roller 31 may increase. Therefore, when the recording medium having a small size is fixed continuously, or when a driving of the apparatus suddenly stops, an excessive temperature of the fixing belt 22 may be controlled. Also, a high exothermic efficiency may be maintained stably and a loss of power consumption may be lessened.

Figure 15A:
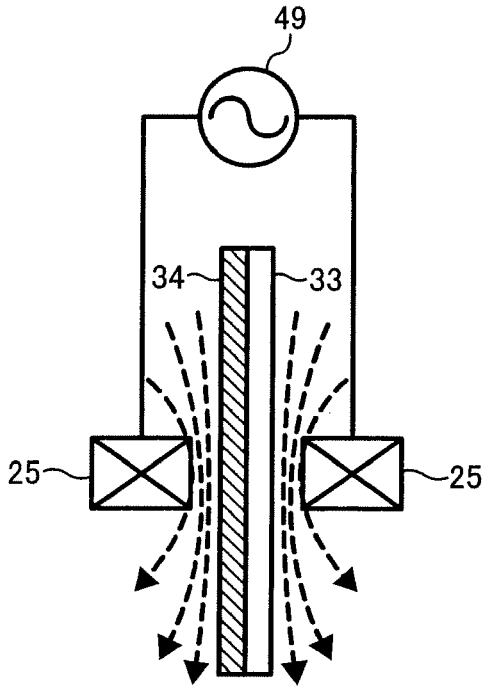
FIG. 15A is a cross-sectional diagram illustrating a configuration of a coil member as an experimental apparatus related to the image fixing apparatus of FIG. 2.
Figure 15B:
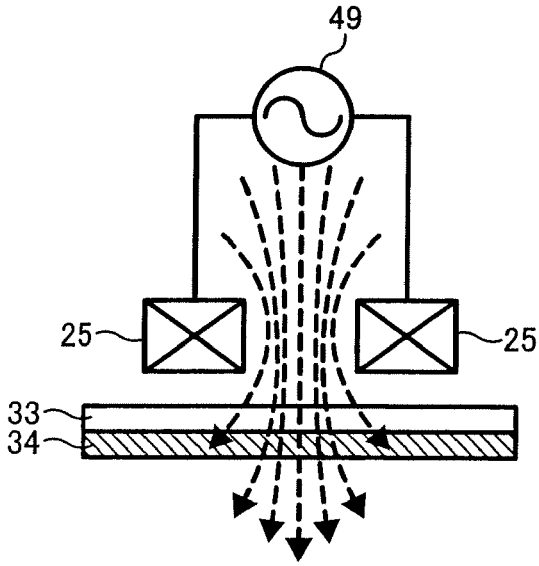
FIG. 15B is a cross-sectional diagram illustrating another configuration of a coil member as an experimental apparatus related to the image fixing apparatus of FIG. 2.
Figure 16A:
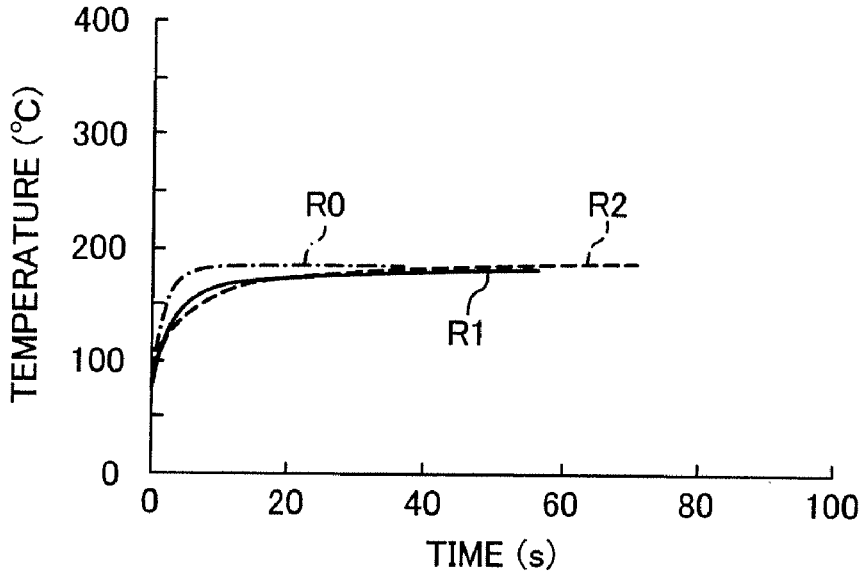
FIG. 16A is a graph showing a rising temperature of a heat layer of the experimental apparatus of FIG. 15A.
Figure 16B:
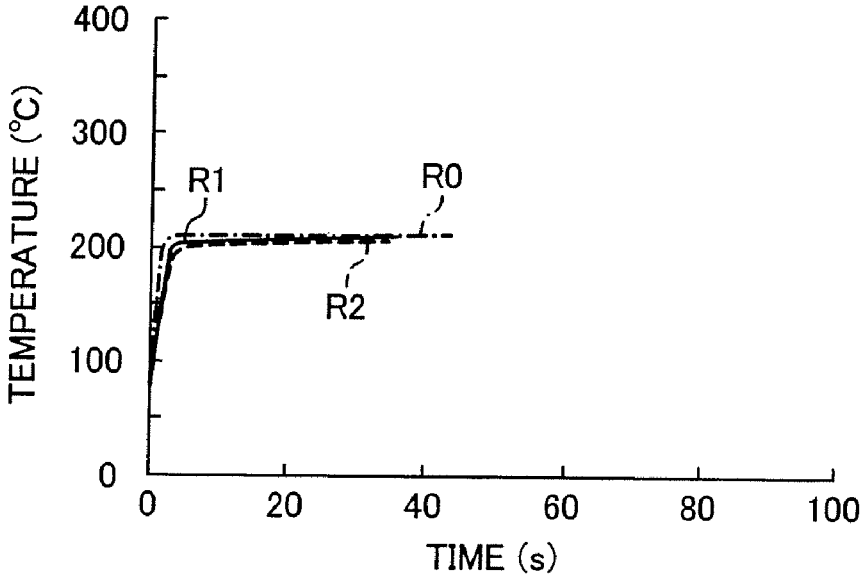
FIG. 16B is a graph showing a rising temperature of a heat layer of the experimental apparatus of FIG. 15A.
Figure 17A:
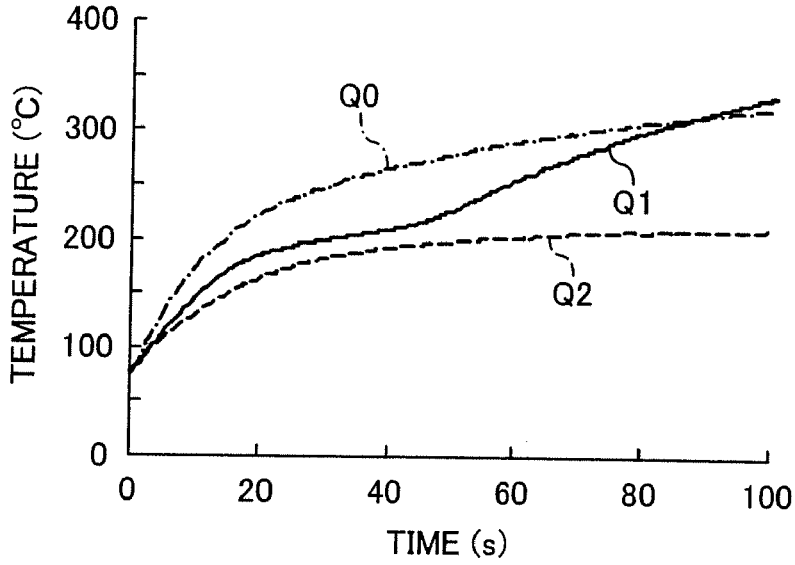
FIG. 17A is a graph showing a rising temperature of a heat layer of the experimental apparatus of FIG. 15B.
Figure 17B:
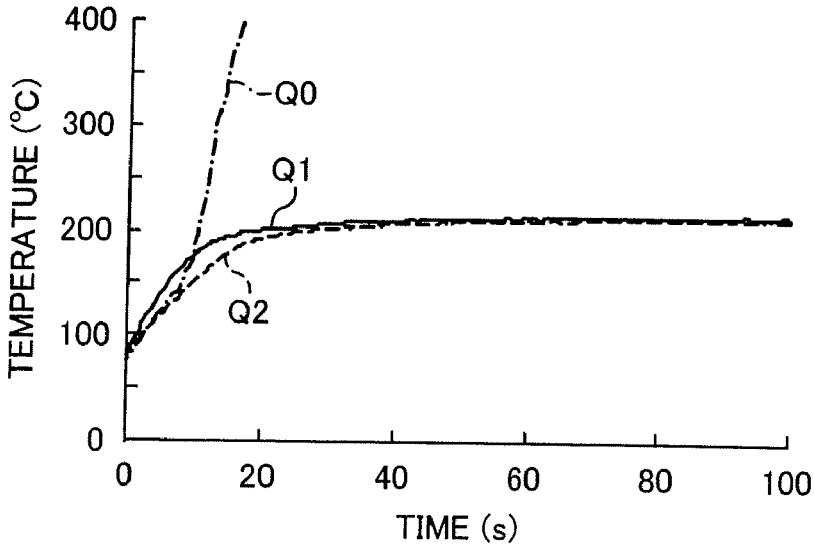
FIG. 17B is a graph showing a rising temperature of a heat layer of the experimental apparatus of FIG. 15B.

Next, experimental results are explained. FIG. 15A is a cross-sectional diagram illustrating a configuration of a coil member as an experimental apparatus related to the image fixing apparatus of FIG. 2. FIG. 15B is a cross-sectional diagram illustrating another configuration of a coil member as an experimental apparatus related to the image fixing apparatus of FIG. 2. FIG. 16A is a graph showing a rising temperature of a heat layer of the experimental apparatus of FIG. 15A. FIG. 16B is also a graph showing a rising temperature of a heat layer of the experimental apparatus of FIG. 15A. FIG.17A is a graph showing a rising temperature of a heat layer of the experimental apparatus of FIG. 15B. FIG. 17B is also a graph showing a rising temperature of a heat layer of the experimental apparatus of FIG. 15B. As shown in FIG. 15A, the experimental apparatus has a loop-like coil member 25 facing a front and a back sides of a test piece having a heat layer 33 which is equivalent to an exothermic component. As shown in FIG.15B, the experimental apparatus has a loop-like coil member 25 facing one side of a test piece having a heat layer 33 which is equivalent to an exothermic component.

That is, as shown in FIGS. 15A and 15B, only direction of the test piece against the coil member 25 is different.

A first test piece only includes the heat layer 33. A second test piece has an Aluminum electric conduction layer 34 having a thickness of 0.3 mm, which is on the heat layer 33. A third test piece has an Aluminum electric conduction layer 34 having a thickness of 0.8 mm, which is on the heat layer 33. The heat layer 33 is made of a temperature compensation alloy which has a Curie point of 240 degrees C. The heat layer 33 has an area of 25 mm×50 mm, and has a thickness of 0.22 mm. The Aluminum electric conduction layer 34 also has an area of 25 mm×50 mm.

The high frequency power supply 49 has an electric power of 200 to 1200 W, and two kinds of alternate current (36 kHz and 130 kHz for excitation frequency) are applied to the coil member 25 of the experimental apparatus. A line of magnetic force as shown in FIGS. 15A and 15B is formed in about coil member 25.

FIGS. 16A, 16B, 17A, and 17B show experimental results. In FIGS. 16A, 16B, 17A, and 17B, a horizontal axis is a time after starting electromagnetic induction, and a vertical axis is a temperature on the heat layer 33.

FIG. 16A is a graph which shows the relation of the time and temperature when the high frequency power supply 49 has a 36 kHz frequency. FIG. 16B is a graph which shows the relation of the time and temperature when the high frequency power supply 49 has a 130 kHz frequency. An R0 shows a result of using the first test piece. An R1 shows a result of using the second test piece. An R2 shows a result of using the third test piece.

FIG. 17A is a graph which shows the relation of the time and temperature when the high frequency power supply 49 has a 36 kHz frequency. FIG. 17B is a graph which shows the relation of the time and temperature when the high frequency power supply 49 has a 130 kHz frequency. A Q0 shows a result of using the first test piece. A Q1 shows a result of using the second test piece. A Q2 shows a result of using the third test piece.

As shown in FIGS. 16A and 16B, there is no relation to an existence of the electric conduction layer 34, or the frequency of the alternate current. When the temperature of the heat layer 33 reaches a Curie point, an excessive temperature rising is reduced or prevented after that. On the other hand, as shown in FIG. 17A, when the excitation frequency is 36 kHz, an excessive temperature rising of the heat layer 33 may not be reduced or prevented without the electric conduction layer 34 which has a thickness of 0.8 mm or more. As shown in FIG. 17B, when the excitation frequency is 130 kHz, an excessive temperature rising of the heat layer 33 may not be reduced or prevented without the electric conduction layer 34 which has a thickness of 0.3 mm or more. Thus, when the coil member 25 is faced to one side of an exothermic component (a heat layer 33), it is necessary to provide a non-magnetism and electric conduction layer of low electric resistivity on the opposite side of the exothermic component.

The above results show that the capability of self-temperature control of an exothermic component is increased by inserting the exothermic component into the loop-like coil member 25. Comparing FIGS. 16A, 16B, 17A, and 17B, the exothermic efficiency (a rise up) of an exothermic component also improves by inserting the exothermic component into the loop-like coil member 25. Further, since an above-mentioned effect is obtained without forming the electric conduction layer 34 in an exothermic component, a composition of the exothermic component may be simplified. Therefore, an exothermic component without the fault such as peeling between layers may be provided, which is low cost.

This invention is not limited to the above-mentioned examples. It is clear that the form of each above-mentioned example may be suitably changed within the limits of this invention. Also, the number of components, a position, form, etc. are not limited to the form of each above-mentioned example, when carrying out this invention, they may have a suitable number, a position, form, etc.

Numerous additional modifications and variations are possible in light of the above teachings. It is therefore to be understood that within the scope of the disclosure, this patent specification may be practiced otherwise than as specifically described herein.

The invention claimed is:

1. An image fixing apparatus to fix a toner image onto a recording medium, comprising:

a U-shaped coil member configured to generate a magnetic flux;

a heat member configured to generate heat with the magnetic flux and disposed between legs of the U-shaped coil member; and a support member that supports the coil member so that the coil member faces a front and a back side of the heat member, wherein the support member includes a heat dissipation part that releases heat generated in the coil member, wherein the heat dissipation part comprises a highly thermally-conductive material, and a non-magnetic material is used as the highly thermally-conductive material.

2. The image fixing apparatus of claim 1, wherein a thermal conductivity of the highly thermally-conductive material is higher than that of a coating layer of the coil member.

3. The image fixing apparatus of claim 1, wherein the legs of the U-shaped coil member are parallel to an axis of rotation around which the heat member is configured to rotate.

4. An image fixing apparatus to fix a toner image onto a recording medium, comprising:

a coil member configured to generate a magnetic flux;

a heat member configured to generate heat with the magnetic flux; and a support member that supports the coil member so that the coil member faces a front and a back side of the heat member, wherein the support member includes a heat dissipation part that releases heat generated in the coil member, and the heat dissipation part comprises a highly thermally-conductive material, and a non-magnetic material is used as the highly thermally-conductive material.

5. The image fixing apparatus of claim 4, wherein the heat dissipation part includes a heat pipe.

6. The image fixing apparatus of claim 4, wherein a width range of the heat dissipation part includes that of the heat member and a part of the heat dissipation part is not surrounded by the heat member.

7. The image fixing apparatus of claim 4, wherein a part of the support member is a heat insulation part configured to insulate the coil member from heat.

8. The image fixing apparatus of claim 4, wherein an alternating current is applied to the coil member.

9. The image fixing apparatus of claim 4, wherein the heat layer is made of a temperature compensation alloy.

10. The image fixing apparatus of claim 4, wherein the heat member is a fixing member to fix a toner image.

11. The image fixing apparatus of claim 10, wherein the fixing member is a fixing belt and the coil member faces a front and a back side of the fixing belt.

12. The image fixing apparatus of claim 11, further comprising:

a pressing roller;

a support roller; and an auxiliary fixing roller configured to apply a tension on the fixing belt with the support roller and to press a recording medium with the pressing roller through the fixing belt.

13. The image fixing apparatus of claim 12, wherein the coil member is arranged so that it faces a back side of the fixing belt through the support roller.

14. The image fixing apparatus of claim 10, wherein the fixing member is a fixing roller configured to contact a pressing roller that presses a recording medium and the coil member faces a front and a back side of the fixing roller.

15. The image fixing apparatus of claim 4, wherein the heat member heats a fixing member to fix a toner image.

16. The image fixing apparatus of claim 4, wherein the heal member includes a heat layer that has a Curie point of 300 degree C. or less.

17. An image forming apparatus, comprising:

an image fixing apparatus configured to fix a toner image onto a recording medium including a coil member configured to generate a magnetic flux, a heat member configured to generate heat with the magnetic flux, and a support member that supports the coil member so that the coil member faces a front and a back side of the heat member, wherein the support member includes a heat dissipation part that releases heat generated in the coil member, wherein the heat dissipation part is formed with a highly thermally-conductive material, and a non-magnetic material is used as the highly thermally-conductive material.

18. The image forming apparatus of claim 17, wherein the heat member includes a heat layer that has a Curie point of 300 degree C. or less.

19. An image fixing apparatus, comprising:

an image fixing apparatus configured to fix a toner image onto a recording medium including coil member configured to generate a magnetic flux, a heat member configured to generate heat with the magnetic flux, and a support member that supports the coil member so that the coil member faces a front and a back side of the heat member, wherein the support member includes a heat dissipation part that releases heat generated in the coil member, wherein the heat dissipation part is formed with a highly thermally-conductive material, and a non-magnetic material is used as the highly thermally-conductive material, and wherein the heat member is a support roller and is configured to revolve around the support member and to slide upon a perimeter of the support member.

20. The image fixing apparatus of claim 19, wherein the perimeter of the support member includes a fluoro-resin.

21. An image fixing apparatus to fix a toner image onto a recording medium, comprising:

a coil member configured to generate a magnetic flux;

a heat member configured to generate heat with the magnetic flux; and a support member that supports the coil member so that the coil member faces a front and a back side of the heat member, wherein the support member includes a heat dissipation part that releases heat generated in the coil member, wherein the heat member heats a fixing member to fix a toner image, the heat dissipation comprises a highly thermally-conductive material, and a non-magnetic material is used as the highly-thermally-conductive material, the image fixing apparatus further comprising:

a pressing roller; and an auxiliary fixing roller configured to apply tension to a fixing belt, the fixing belt being the fixing member, and to press a recording medium with the pressing roller through the fixing belt, a support roller being the heat member, wherein the coil member faces a front side of the fixing belt and a back side of the fixing belt through the support roller.

* * * * *